United States Patent [19]

Wehner, deceased

[11] 4,188,288

[45] Feb. 12, 1980

[54] SCREEN WITH TUBULAR FRAME SYSTEMS COUPLED FOR RECTILINEAR MOTION

[75] Inventor: Albert Wehner, deceased, late of Wieladingen, Fed. Rep. of Germany, by Elfriede Wehner, legal representative

[73] Assignee: Hein, Lehmann AG, Dusseldorf, Fed. Rep. of Germany

[21] Appl. No.: 881,265

[22] Filed: Feb. 27, 1978

Related U.S. Application Data

[63] Continuation of Ser. No. 650,113, Jan. 19, 1976, which is a continuation of Ser. No. 501,652, Aug. 29, 1974, abandoned, which is a continuation of Ser. No. 310,806, Nov. 30, 1972, abandoned.

[51] Int. Cl.[2] ..... B07B 1/42

[52] U.S. Cl. ..... 209/310; 209/342; 209/396

[58] Field of Search ..... 209/396, 393, 310, 325, 209/342, 415

[56] References Cited

U.S. PATENT DOCUMENTS

| | | | |
|---|---|---|---|
| 287,154 | 10/1883 | Parisn | 209/342 |
| 719,805 | 2/1903 | Ingle | 209/342 X |
| 1,707,251 | 4/1929 | Cederquist | 209/347 |
| 2,870,910 | 1/1959 | Wehner | 209/396 |
| 3,208,594 | 9/1965 | Wehner | 209/396 X |
| 3,231,088 | 1/1966 | Grasse | 209/342 X |
| 3,378,142 | 4/1968 | Wehner | 205/325 |
| 3,633,745 | 1/1972 | Wehner | 209/310 |
| 3,647,068 | 3/1972 | Wehner | 209/310 |
| 3,841,481 | 10/1974 | Wehner | 209/310 |

FOREIGN PATENT DOCUMENTS

| | | | |
|---|---|---|---|
| 670204 | 9/1963 | Canada | 209/396 |
| 691264 | 7/1964 | Canada | 209/396 |
| 1168387 | 10/1969 | United Kingdom | 209/310 |

*Primary Examiner*—Robert Halper

*Attorney, Agent, or Firm*—Allison C. Collard; Thomas M. Galgano

[57] ABSTRACT

A screening mechanism which has two ladder-shaped frame systems with spaced parallel ladder stringers and spaced parallel ladder rungs extending between the stringers, wherein at least one of the said frame systems is moving relatively to the other frame system to form sieve zones of continuously changing width with alternating dips of a different depth, curved arches or a different tension in a stretched condition, whereby at least one of the said frame systems is connected to a driving means such as a crankshaft, electro-magnets, pneumatic or hydraulically driven cylinders or the like and is held on link springs, swing supports, rollers, suspended swings, cables, swing metals or the like, while the other frame system is moving by the same driving means shifted by 180°.

3 Claims, 12 Drawing Figures

SCREEN WITH TUBULAR FRAME SYSTEMS COUPLED FOR RECTILINEAR MOTION

This is a continuation of application Ser. No. 650,113, filed Jan. 19, 1976 for SCREENING MECHANISM, which is a continuation of prior co-pending appl. Ser. No. 501,652, filed Aug. 29, 1974 (now abandoned), which, in turn, is a continuation of prior co-pending appl. Ser. No. 310,806 filed Nov. 30, 1972 (now abandoned).

This invention relates to a screening mechanism.

U.S. Pat. No. 3,647,068 of the same inventor and assignee describes a screening mechanism comprising two systems of elongated screen-carrying members, said two systems, in static condition thereof, extending in substantially the same horizontal plane, said carrying members being disposed spaced from one another in a given direction and substantially in alignment with one another so that the longitudinal axes thereof extend transversely to said direction, the carrying members of one system being in respective alternate arrangement with the carrying members of the other systems, a screening member comprising a web, at least partly deformable by gravity, carried by said carrying members, each of the carrying members of one of said systems being connected by the screening member to the carrying members of the other system adjacent thereto and means for relatively moving said two systems in said given direction transversely to the longitudinal axes of said carrying members so as to vary continually the spacing between the adjacent carrying members in the dynamic condition of said systems, said moving means comprising a rotatable member connected to each of said systems for imparting a circular motion to the axis of each of the carrying members of the respective systems, in the dynamic condition of said systems, so that said axis transverses a substantially cylindrical locus, and said screening member is deformed in accordance with said varied spacing between said carrying members so as to vary the effective screening area of said screening member.

The screen machines constructed according to the U.S. patent, have practically been proved excellent, especially for machine processing of hard to screen goods, such as processing of coal, ore, sand, gravel and waste. However, it became apparent, that as a result of the large machine expenditure, the profitability of using such screening machines is endagered in such cases, where relatively small amounts are involved, or problems of fine and finest screening are to be solved. Further those extremely large substance screening machines have proved disadvantageous when the surface in a screen area or -deck is larger than 10 $m^2$. In additon it was found, that the peculiar movements of the screen bottom of the screening machines, built according to U.S. Pat. No. 3,647,068 were not efficient in acceleratling, loosening and transporting sticky screening material.

An object of the present invention is to provide a screening mechanism which does not have the above mentioned disadvantages, but permits the manufacture and operation of smaller as well as larger screening machines, without diverting from the basic invention according to above mentioned patent.

Another object is to design the two, relatively towards each other moveable systems, forming the screening machines, in such a way, as to be assembled in a simple manner, while having the slightest possible own weight at highest possible load capacity. Simultaneously the screening mechanism should be improved in such a way, that with regard to various screening tasks and screening goods, the best suitable screen bottom movement may be materialized.

Other objects of the present invention will become apparent in the course of the following specification.

In accomplishing the objectives of the present invention it was found desirable to provide two systems moveable relatively to each other and consisting of two ladder-like frames, whereby each frame is constructed of two stringers extending at a distance, parallel to each other, tightly connected by a number of rungs running parallel and spaced at a distance from each other, the two ladder-like frames simultaneously forming the two systems, relatively moveable towards each other are arranged in or on top of each other, so that always one rung of the ladder-like frame of one system is adjacent, at a distance, to a rung of the ladder-like frame of the other system. Since the elastic screen bottom is attached to the rungs of the two ladder-like frames, and the two frames execute a relative movement towards one another the two afore-mentioned adjacent rungs form sieve zones of continuously changing width with alternating dips of a different depth, curved arches or a different tension in a stretched condition of the elastic screen bottom. For this purpose, the two ladder-like frames are coupled with a drive and displaced along each other via rollers, guide springs, suspension hinges or ropes, hinged supports, vibration mounts or such, that the ladder-like frame executes exclusively linear movements. The ladder-like frames are preferably formed of pipes and only one frame has two light sheets as side walls, eliminating a specially framed and heavy screen oase. The side walls serve besides guiding the screen material, as side borders to the elastic screen bottom when special side bonds are not provided.

The construction of the present invention provides a screening mechanism with least possible own weight, at simultaneously highest possible load capacity, making the simple production and advantageous application of small screening machines, as used e.g. in the chemical and pharmaceutical industry equally problem free, as that of screening machines whose screen bottom in a screen area or screen deck is essentially larger than 10 $m^2$. The extremely light own weight of the screening mechanism results in an essential relief of the screening machine drive, whereby at equal or higher screening capacity, drives with substantially lower capacity may be used.

Furthermore, the screening mechanism according to the present invention provides a solution for the handling of most difficult screening material, namely by the two ladder-like frames being arranged on top of each other, and by means of a mutual drive, being moved relatively linear towards each other, thus causing the elastic screen bottom, fastened to the rungs of the two ladder-like frames, to adapt a graded or cascade like, constantly altering shape, and so imposes a considerably higher acceleration- and loosening effect onto the screening material. Further advantages of the screening mechanism according to this invention are the constantly changing graded or cascade like movements of the screen bottom, permitting material collected at a low level, e.g. mud, to convey or transport continuously to a higher level, if the screening machine equipped in such a way, is arranged in the mud container at the respective slope.

The invention will appear more clearly from the following detailed description when taken in connection with the accompanying drawings showing by way of example only, preferred embodiments of the inventive idea.

Figure 1:
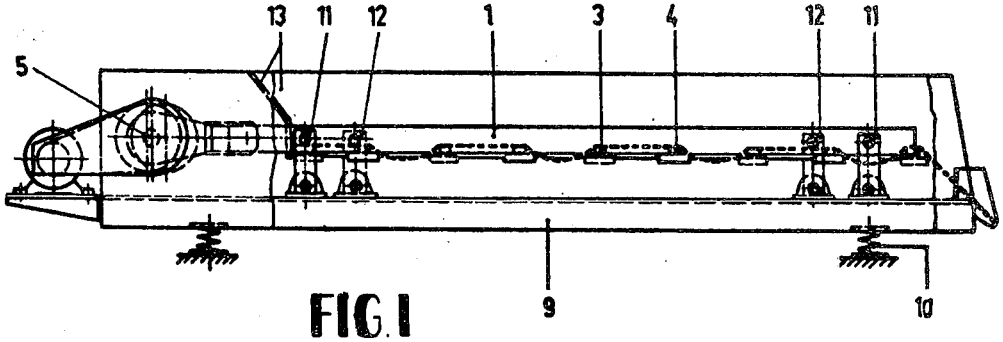
FIG. 1 is a side view of a sieve machine embodying the present invention.
Figure 2:
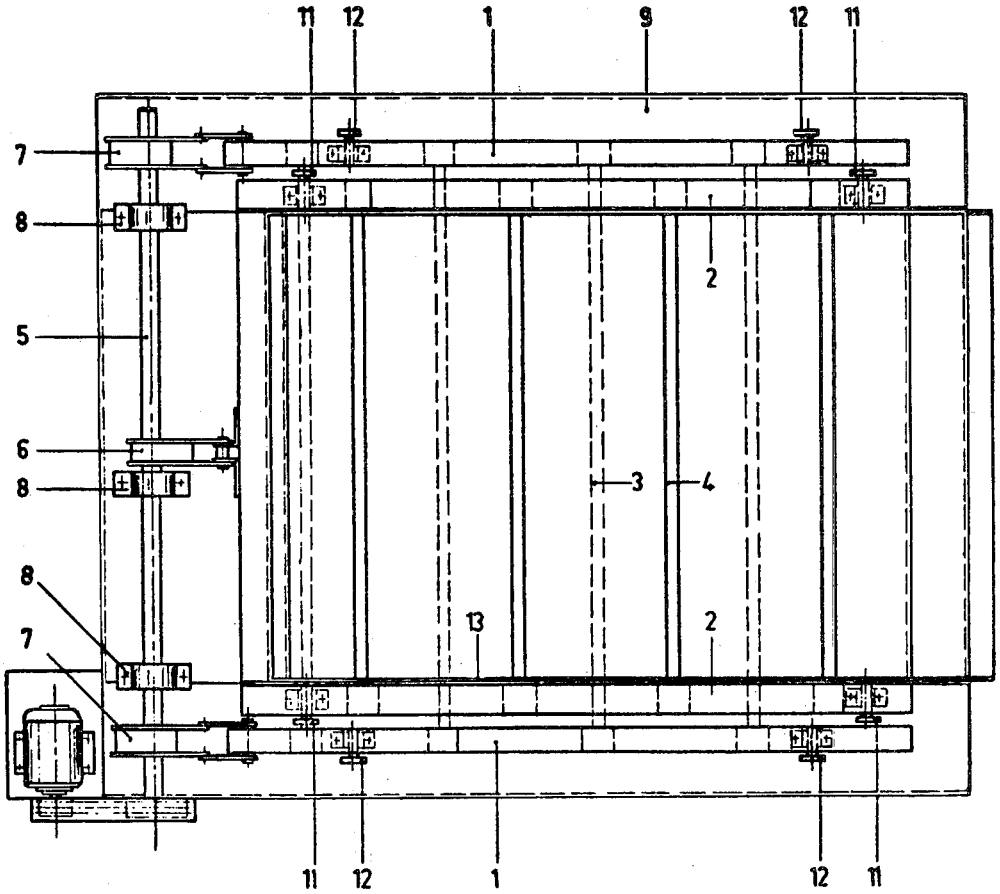
FIG. 2 is a top view of the machine.
Figure 3:
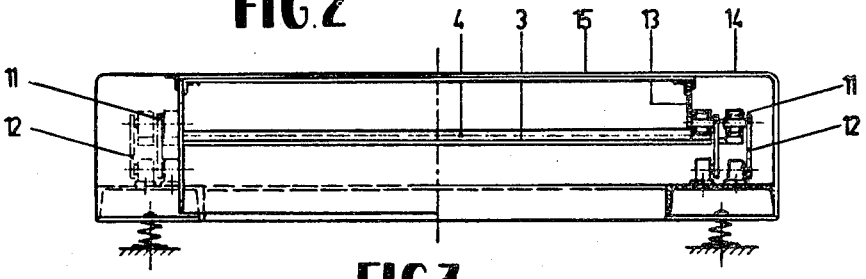
FIG. 3 is a vertical section, some parts being shown in side view.

The screening mechanism shown in FIGS. 1, 2 and 3 is constructed in accordance with the present invention to provide only linear rectilineal movements of the ladder-shaped rungs respectively of the two ladder-shaped frame systems. The ladder-shaped frame systems movable relatively to each other and are driven by an crankshaft 5 through connecting members 6, 7 and 7[1] whereby the shaft 5 is carried by bearings 8 upon the rear part of the base frame 9 supported by springs 10 to isolate machine swingings from the setting up frame.

Each of the two ladder-like frame systems consists of two stringers 1 or 2, running at a distance parallel along each other tightly connected to parallel running rungs 3 or 4 between the stringers, whereby the stringers as well as the rungs are preferably constructed as pipes. The two ladder-like frame systems are as shown in the design, mounted in such a way, that rungs 3, 4 are on the same level, whereby each of the rungs 3, assigned to stringers 1, is adjacent rung 4 assigned to the two stringers 2, at a distance in such a way, that the adjacent rungs 3, 4, as a result of the relative movement of the two frame systems, form an aperture of constantly altering width.

The elastic screen bottom is fastened to the exclusively linear and straight, to and from each other moving rungs 3, 4, as to form between two adjacent rungs 3, 4 sieve zones of continuously changing width with alternating dips of a different depth, curved arches or a different tension in a stretched condition of the elastic screen bottom.

FIGS. 1, 2 and 3 show the apparatus in a horizontal position for illustration purposes. In actual practice it was found preferable to incline the machine to the extent of 10°–15° to provide transportion for the goods being treated. A cover metal sheet 14 can be used to cover the side drive of the system. This greatly stabilizes the side frame carrier and also provides a harmonic view of the machine. In this embodiment the ladder-shaped frame systems are supported by steering members 11 and 12 so as to be linearly swingable. Cheek-like supports and metal sheets 13 are provided upon the inner side of the frame system 2 to guide the goods being treated. Due to the larger height to which the goods are thrown if the construction of the above mentioned patent is used, a cover 15 can be used which serves at the same time as the strike receiving frame.

Figure 4:
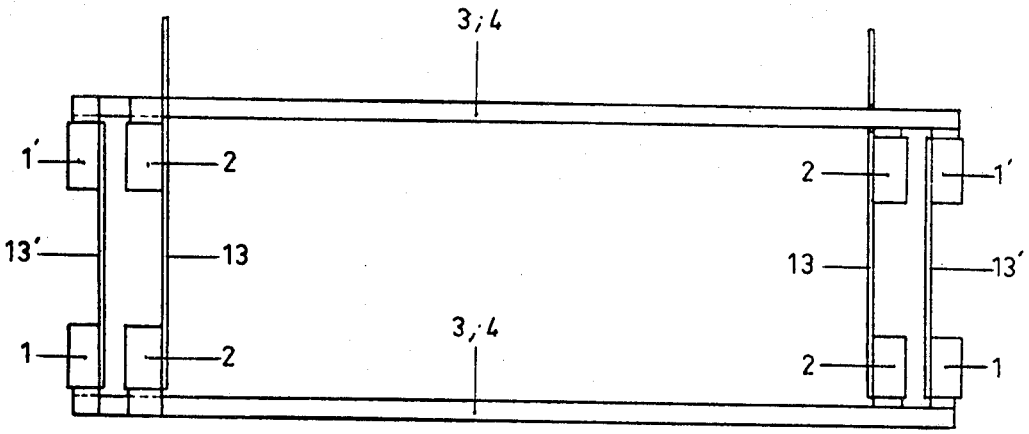
FIG. 4 is a diagram illustration the basic structure of a double deck sieve machine of the present invention.

FIG. 4 shows diagrammatically the structure of the double deck sieve machine of the present invention; only the two ladder-shaped frame systems are shown. The operation of this machine and its supports are the same as those of the device illustrated in FIG. 1, 2 and 3.

Figure 5:
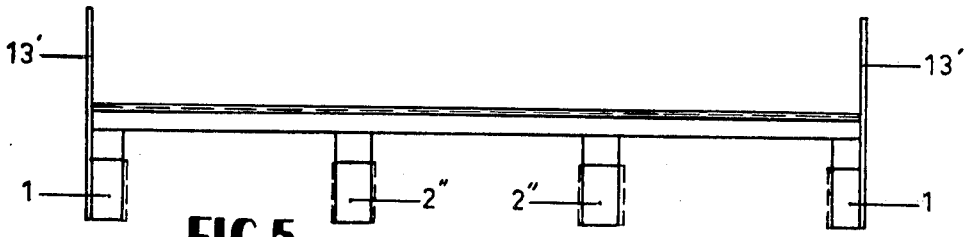
FIG. 5 is a side view showing another embodiment of the machine.
Figure 6:
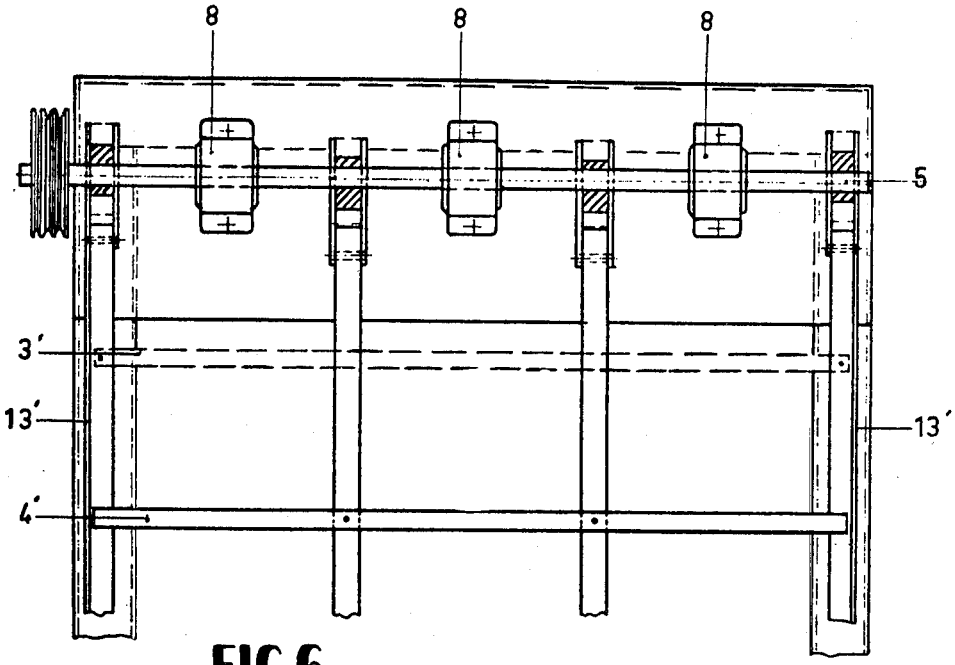
FIG. 6 is a top view of the machine shown in FIG. 5.

The machine shown in FIGS. 5 and 6 is of particularly simple structure due to the inner location of the ladder-shaped stringer 2'' carrying ladder-shaped rungs 4' (spokes) so that the outer sides are simplified. Actually the side metal sheets 13' form the side closure of the machine. The crankshaft 5 with its bearings 8 is located upon a base frame (not shown) with corresponding connections in a manner similar to that shown in FIGS. 1, 2 and 3.

Figure 7:
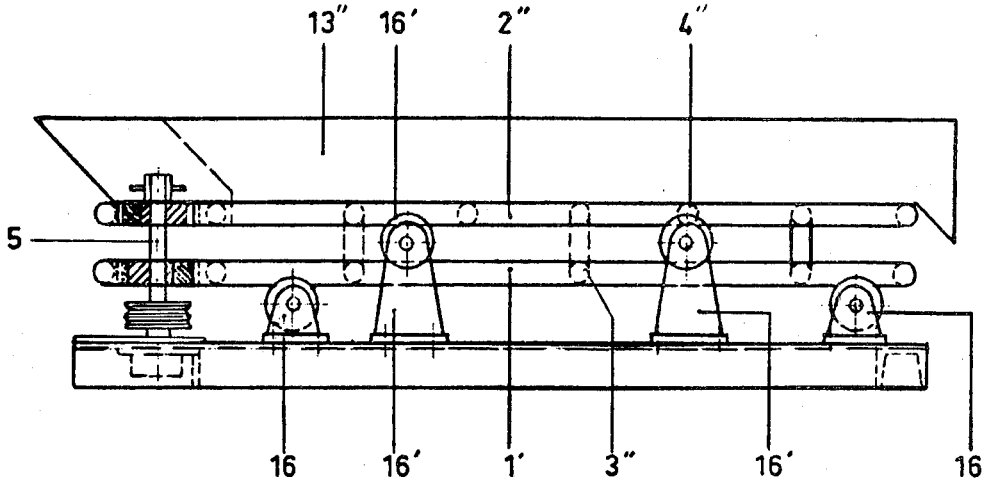
FIG. 7 is a side view of yet another embodiment.
Figure 8:
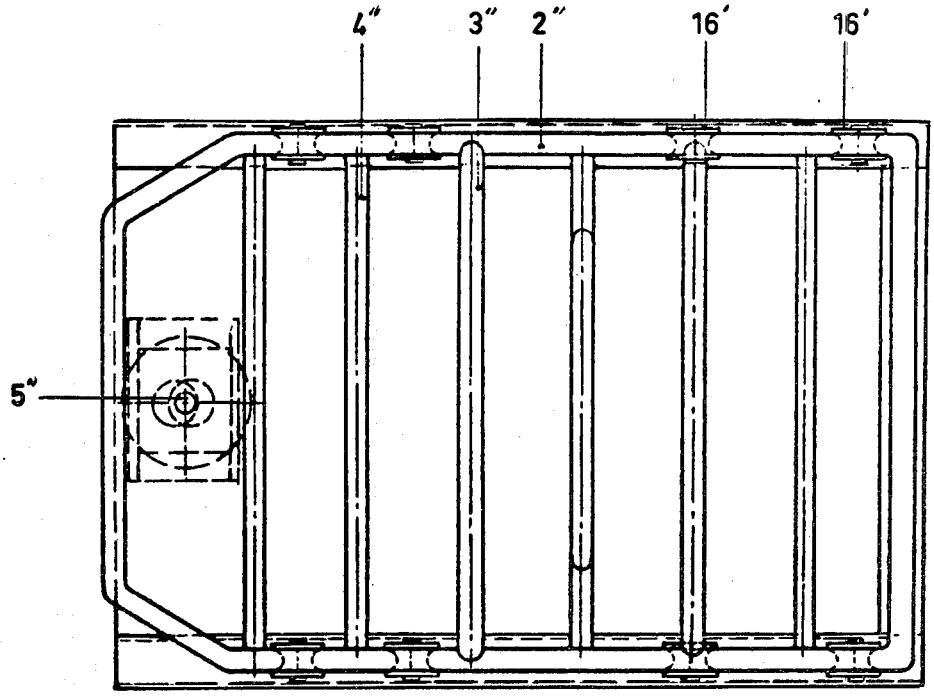
FIG. 8 is a top view of the machine shown in FIG. 7.

The machine shown in FIGS. 7 and 8 is particularly suitable for small sieve machines and provides a substantial simplification of the crankshaft drive. In this construction the crankshaft 5'' extends vertically and is used for driving the ladder shaped frame 1'' and 2'' located one over the other. The frame system 1'' has rungs 3'' which extend to the effective surface of the rungs 4'' of the frame system 2''. In this construction the frame systems are guided by rollers 16 and 16'. Obviously, other means may be provided, such as guide springs, swinging supports or the like. The guide 13'' for the goods is similar to those of the previously described embodiments.

Figure 9:
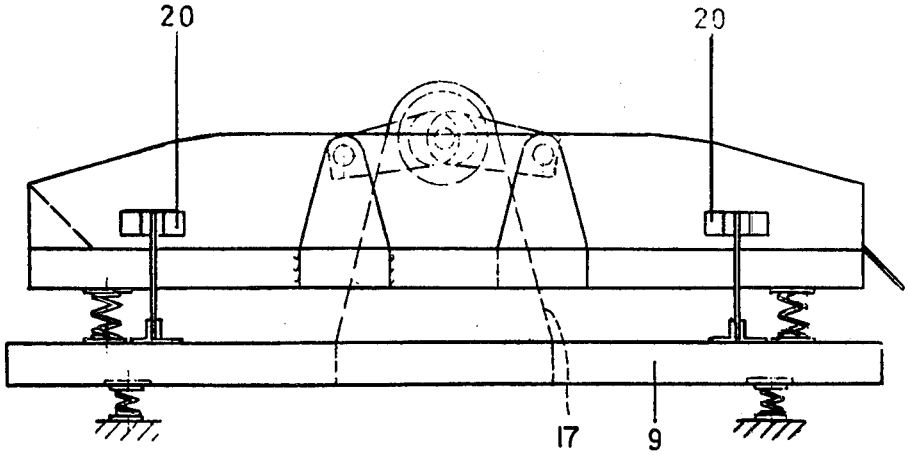
FIG. 9 is a diagrammatic side view of still another embodiment.
Figure 10:
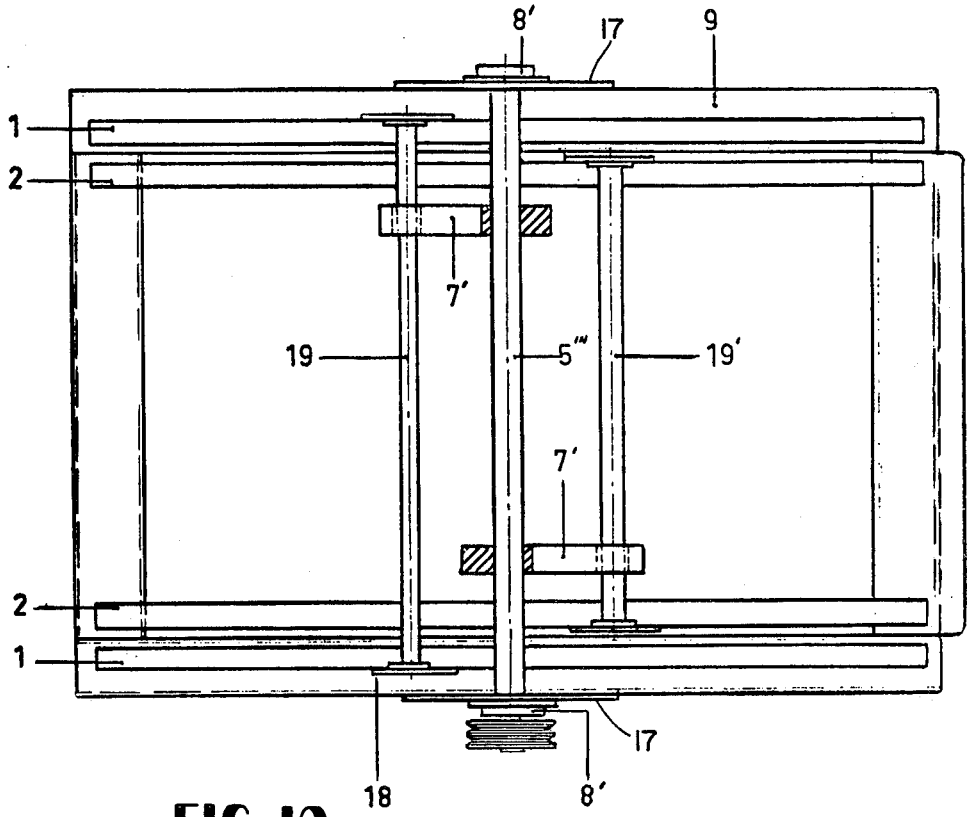
FIG. 10 is a top view of the machine shown in FIG. 9.

FIGS. 9 and 10 show an embodiment of the sieve machine of the present invention wherein the drive is located above the sieve surface in a vertical extention of the center of gravity. The drive has an crankshaft 5''' with its bearings 8' mounted upon supports 17 connected with the base frame 9. The ladder-shaped stringers 1 and 2 have connecting discs 18 attached to driving carriers 19 and 19' with which connecting rods 7' are combined. Thus the ladder-shaped frame systems are subjected to linear swingings through the guide springs 20. To provide clearer illustrations the rungs 3 and 4 have not been shown.

Figure 11:
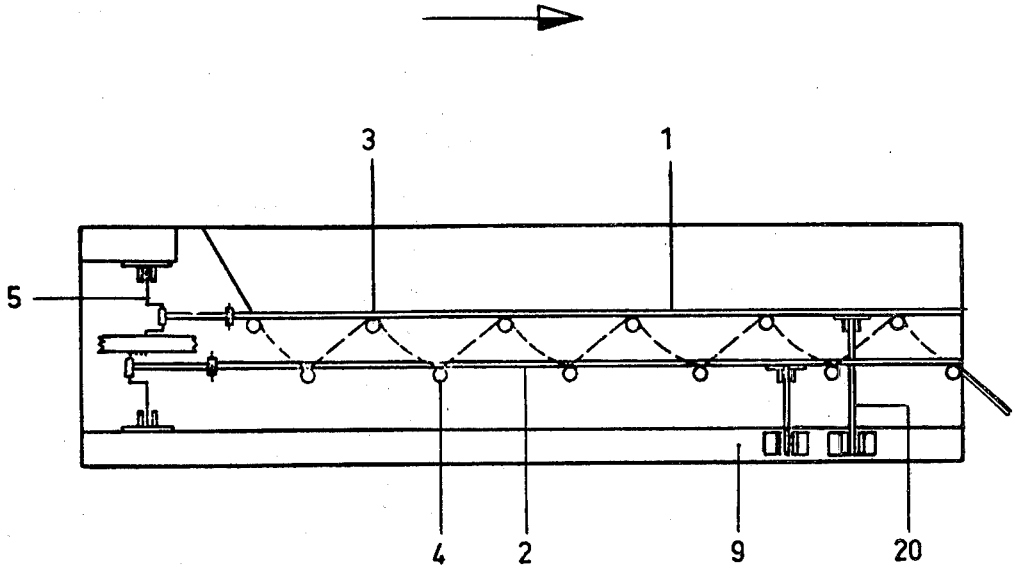
FIG. 11 is a top view of a differently constructed machine.

FIG. 11 shows a sieve machine of the present invention with a vertical drive. The ladder-shaped frame systems 1 and 2 are not located in the same plane and are so driven one above the other, that a step-wise structure or such as a cascade of the elastic sieve bottom is produced which will have great advantages in point of loosening and output at treating some sieve goods which are difficult to separate. The structure of the elastic sieve bottom in form of steps or cascades makes it possible to use the sieve machine of the present invention as a transporting and/or filtering device, e.g. to deliver and to drain coincidentally of muds or the like.

Figure 12:
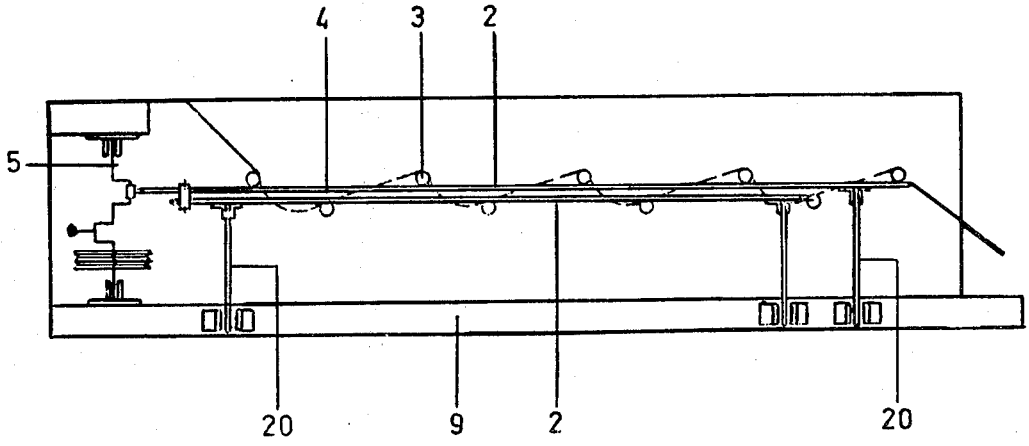
FIG. 12 shows in top view a somewhat different variant.

FIG. 12 shows diagrammatically a very simple construction of a sieve machine in accordance with the present invention. In this case only one of the two ladder-shaped frame systems is operated by a vertical drive, while the second frame system which is swingably supported in the same plane, is driven by elastic transverse elements of the mounted sieve bottom which interconnect the two frame systems. In this case the elastic sieve bottom is actually an elastic coupling for the movement of the two frame systems which are linear swingable in the same direction by the vertical drive.

It is apparent that many variation of the illustrated embodiments are possible within the scope of the present invention, as set forth in the appended claims.

What is claimed is:

1. A screening mechanism of the type having a base frame, two frame systems, each of which include two spaced-apart, longitudinally-extending, beams and a plurality of transversely-extending, spaced-apart rods, the ends of which are coupled to said beams, said frame systems being disposed relative to one another such that each of the rods of one frame system are disposed between the rods of the other frame system, said frame systems including an elastic sieve bottom secured alternately to the rods of the one frame system and the rods of the other frame system and bridging the spaces between said rods, means for movably mounting one of said frame systems on said base frame and means for movably mounting said other frame system on said base frame and drive means for moving said frame systems in a longitudinal direction thereof relative to one another, the improvement comprising:

said frame systems each forming a ladder-shaped frame system which comprises two tubular beams and a plurality of tubular rods, the ends of the latter of which are fixably secured to said beams, and said frame systems being mounted at an angle of inclination on said base frame;

spaced supports for each said beam and connecting means coupling said drive means to each of said frame systems;

said means for movably mounting said frame systems effecting exclusively rectilinear movement of said frame systems so that said drive means moves said frame systems in countermoving rectilinear oscillations; and a pair of vertically disposed, longitudinally-extending sheet metal guide sheets carried by one of said frame systems, said guide sheets being disposed on opposite lateral sides of said one frame system.

2. The mechanism according to claim 1, wherein said frame systems are mounted at an angle of inclination of between 10 and 15 degrees.

3. A screening mechanism of the type having a base frame, two frame systems, each of which include two spaced-apart, longitudinally-extending, beams and a plurality of transversely-extending, spaced-apart rods, the ends of which are coupled to said beams, said frame systems being disposed relative to one another such that each of the rods of one frame system are disposed between the rods of the other frame system, said frame systems including an elastic sieve bottom secured alternately to the rods of the one frame system and the rods of the other frame sytem and bridging the spaces between said rods, means for movably mounting one of said frame systems on said base frame and means for movably mounting said other frame system on said one frame system and drive means for moving said frame systems in a longitudinal direction thereof relative to one another, the improvement comprising:

said frame systems each forming a ladder-shaped frame system which comprises two tubular beams and a plurality of tubular rods, the ends of the latter of which are fixably secured to said beams, and said frame systems being mounted at an angle of inclination on said base frame and spaced supports for each tubular beam;

said drive means including a crakshaft supported by bearings upon said base frame and connecting members for coupling said crankshaft to each of said frame systems, said crankshaft moving said frame systems in countermoving oscillations 180° out of phase with one another;

said means for movably mounting said frame systems effecting exclusively rectilinear movement of said frame systems so that said drive means moves said frame systems in countermoving rectilinear oscillations; and a pair of vertically disposed longitudinally-extending sheet metal guide sheets carried by one of said frame systems, said guide sheets being disposed on opposite lateral sides of said one frame system.

* * * * *

UNITED STATES PATENT AND TRADEMARK OFFICE

CERTIFICATE OF CORRECTION

PATENT NO. : 4,188,288

DATED : FEBRUARY 12, 1980

INVENTOR(S) : ALBERT WEHNER, DECEASED

It is certified that error appears in the above—identified patent and that said Letters Patent is hereby corrected as shown below:

Column 1, line 49, change "endagered" to --endangered--; lines 57-58, change "acceleratling" to --accelerating--. Column 3, line 34, change "an" to --a--. Column 4, line 38, change "an" to --a--. Column 5, line 3, change "variation" to --variations--; line 26, delete "tubular". Column 6, line 14, change "sytem" to --system--; line 22, delete "tubular"; line 27, delete "tubular"; line 28, change "crakshaft" to --crankshaft--.

Signed and Sealed this

*Third* Day of *February 1981*

[SEAL]

*Attest:*

RENE D. TEGTMEYER

*Attesting Officer*

*Acting Commissioner of Patents and Trademarks*